US009841163B1

(12) United States Patent
Clements

(10) Patent No.: US 9,841,163 B1
(45) Date of Patent: Dec. 12, 2017

(54) LIGHT REDIRECTING FLANGE IN LUMINAIRES

(71) Applicant: Steven Russell Clements, Atlanta, GA (US)

(72) Inventor: Steven Russell Clements, Atlanta, GA (US)

(73) Assignee: Cooper Technologies Company, Houston, TX (US)

( * ) Notice: Subject to any disclaimer, the term of this patent is extended or adjusted under 35 U.S.C. 154(b) by 225 days.

(21) Appl. No.: 14/699,865

(22) Filed: Apr. 29, 2015

(51) Int. Cl.

| | |
|---|---|
| ***F21V 23/02*** | (2006.01) |
| ***F21V 7/00*** | (2006.01) |
| ***F21K 99/00*** | (2016.01) |
| ***F21V 23/00*** | (2015.01) |
| *F21Y 103/00* | (2016.01) |

(52) U.S. Cl.
CPC ..... *F21V 7/0066* (2013.01); *F21K 9/30* (2013.01); *F21V 23/002* (2013.01); *F21Y 2103/003* (2013.01)

(58) Field of Classification Search
CPC .... F21V 15/012; F21V 15/013; F21V 21/005; F21V 29/76; F21V 7/0066; F21V 23/002; F21S 4/28; Y10T 29/49826; F21Y 2101/02; F21Y 2103/003; F21K 9/30
See application file for complete search history.

(56) References Cited

U.S. PATENT DOCUMENTS 5,134,548 A * 7/1992 Turner ..... B67D 7/222 349/58
2003/0039116 A1* 2/2003 Belair ..... F21S 2/00 362/145
2008/0291693 A1* 11/2008 Chen ..... G02B 6/0055 362/609
2010/0053948 A1* 3/2010 Kosters ..... F21V 7/00 362/231
2010/0123159 A1* 5/2010 Song ..... H01L 33/60 257/99
2010/0124943 A1* 5/2010 Amirnovin ..... H04B 1/3816 455/558
2012/0062970 A1* 3/2012 Yamada ..... G02B 7/1821 359/199.4
2012/0256827 A1* 10/2012 Ahn ..... G06F 1/169 345/157
2014/0063803 A1* 3/2014 Yaphe ..... F21V 15/012 362/247
2014/0218913 A1* 8/2014 Cozzolino ..... F21S 8/04 362/235
2014/0268747 A1* 9/2014 Demuynck ..... F21S 9/022 362/235
2016/0153641 A1* 6/2016 Fang ..... F21S 8/026 362/260

* cited by examiner

*Primary Examiner* — Elmito Breval
*Assistant Examiner* — Fatima Farokhrooz
(74) *Attorney, Agent, or Firm* — King & Spalding LLP

(57) ABSTRACT

A luminaire includes a door frame assembly that comprises an end plate. The end plate includes a top edge and a bottom edge that is opposite to the top edge, where the end plate extends from the bottom edge to the top edge. Further, the end plate includes a notch. Furthermore, the end plate may include a light redirecting flange that may be coupled to or integral with the end plate. The light redirecting flange may be positioned adjacent the notch in the end plate and at an angle with the end plate to redirect light from a light source of the luminaire that exits through the notch back towards a lens of the luminaire.

14 Claims, 9 Drawing Sheets

LIGHT REDIRECTING FLANGE IN LUMINAIRES

TECHNICAL FIELD

Embodiments of the present disclosure relate generally to luminaires, and more particularly a light redirecting flange in luminaires.

BACKGROUND

Luminaires often have a lens to diffuse light coming out of the luminaires. For aesthetics reasons, the lens is typically illuminated evenly across the surface of the luminaires. However, in some instances, there are features in a housing and/or a door assembly positioned behind the lens of a luminaire that create dark portions or other unpleasing aesthetics in the lens of the luminaire. In order to reduce or remove the dark portions behind the lens of the luminaire, light needs to be redirected to create a more even illumination across the lens surface.

SUMMARY

In one aspect, the present disclosure can relate to a door frame assembly of a luminaire. The door frame assembly includes a first side rail and a second side rail that is opposite to the first side rail. Each of the first side rail and the second side rail includes a first lateral edge, a second lateral edge opposite to the first lateral edge, and longitudinal edges that extend between the first lateral edge and the second lateral edge. Further, the door frame assembly includes an end plate. The end plate includes a bottom edge that extends from the first side rail to the second side rail, and a top edge that is opposite to the bottom edge. The end plate extends from the bottom edge to the top edge. Furthermore, the door frame assembly includes a light redirecting flange comprising a portion of the end plate that diverges away from a remainder portion of the end plate at an angle to the remainder portion of the end plate.

In another aspect, the present disclosure can generally relate to luminaire that includes a housing, at least one circuit board coupled to the housing that includes at least one light emitting diode (LED) disposed thereon, and a door frame assembly coupled to the housing. The door frame assembly includes a first side rail and a second side rail that is opposite to the first side rail. Further, the door frame assembly includes an end plate extending from a portion of the first side rail to a corresponding portion of the second side rail and having a top edge and a bottom edge opposite to the top edge. Furthermore, the door frame assembly includes a light redirecting flange that is coupled to the end plate adjacent a notch in the end plate. The light redirecting flange may diverge away from the end plate at an angle to the end plate such that light from the at least one LED that exits the luminaire through the notch is redirected towards the lens of the luminaire.

In yet another aspect, the present disclosure can generally relate to a light redirecting flange. The light redirecting flange includes an inward facing surface, an outward facing surface that is opposite to the inward facing surface, a first edge and a second edge that is opposite to the first edge, and a first side edge and a second side edge opposite to the first side edge. The first side edge and the second side edge may extend between the first edge and the second edge. One of the first edge and the second edge of the light redirecting flange may be coupled to an end plate of a luminaire's door frame assembly adjacent a notch in the end plate. Further, the light redirecting flange may be positioned at an angle to the end plate to redirect light from an LED that exits the notch towards a lens of a luminaire.

These and other aspects, objects, features, and embodiments will be apparent from the following description and the appended claims.

BRIEF DESCRIPTION OF THE DRAWINGS

For a more complete understanding of the disclosure and the advantages thereof, reference is now made to the following description, in conjunction with the accompanying figures briefly described as follows.

Figure 1A:
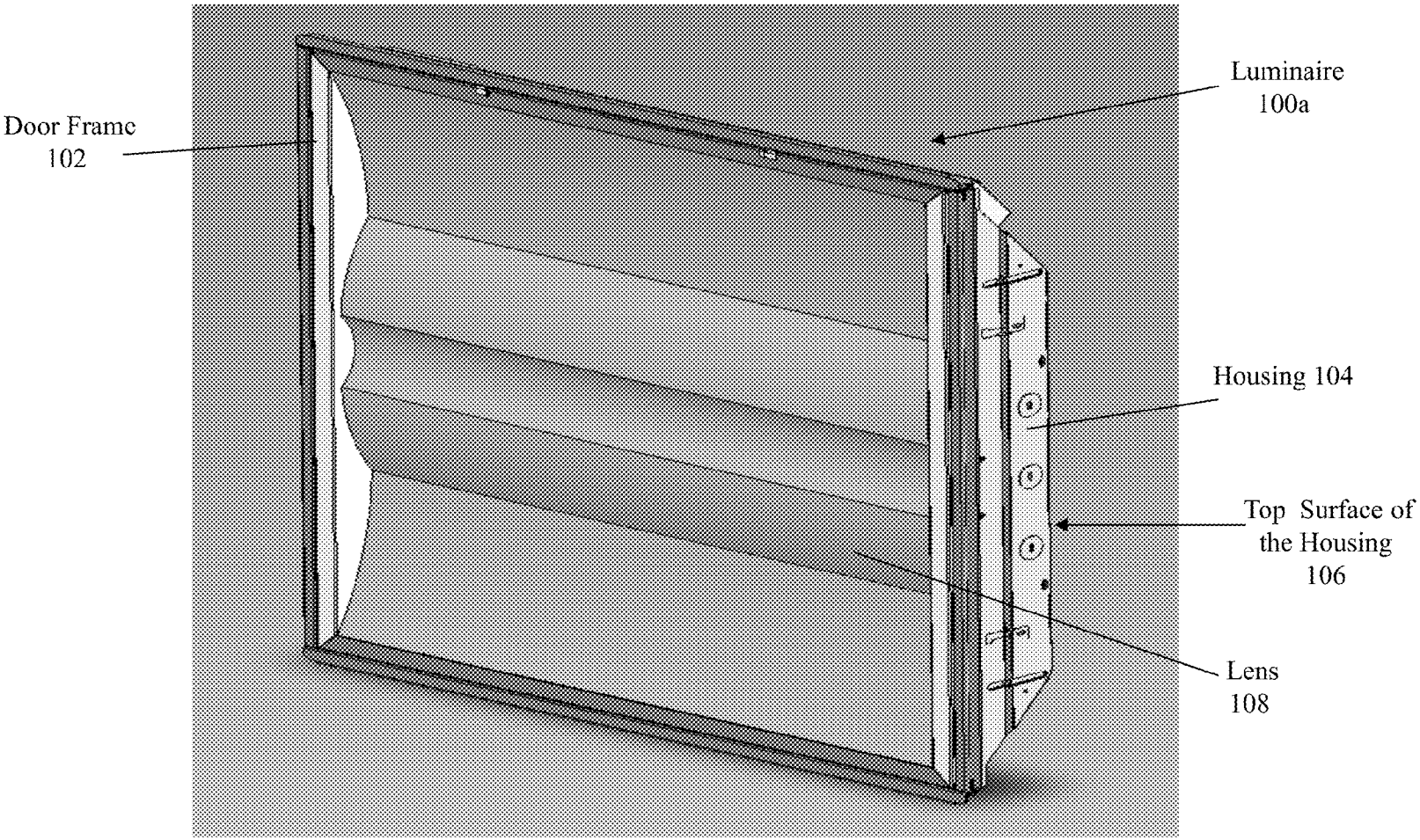
FIG. 1A illustrates a perspective view of an example luminaire comprising the light redirecting flange, in accordance with example embodiments of the present disclosure.

The drawings illustrate only example embodiments of the disclosure and are therefore not to be considered limiting of its scope, as the disclosure may admit to other equally effective embodiments. The elements and features shown in the drawings are not necessarily to scale, emphasis instead being placed upon clearly illustrating the principles of example embodiments of the present disclosure. Additionally, certain dimensions may be exaggerated to help visually convey such principles.

DETAILED DESCRIPTION OF EXAMPLE EMBODIMENTS

Disclosed are example embodiments of a light redirecting flange in luminaires. Before discussing the embodiments of the light redirecting flange, it may assist the reader to understand one or more terms used herein by way of a general description of the terms in the following paragraphs.

The term 'redirecting,' as used herein may generally refer to any appropriate change in direction of light. In some embodiments, redirection may include any appropriate deflection and/or reflection of light. The redirection of light can be achieved in many different ways, some of which may include, but are not limited to, using a reflective coating on a surface to redirect light, using appropriate metal that causes redirection of light, using any appropriate paints of various color, and so on. Further, the characteristics of the surface, such as size and shape of a surface that redirects light, and/or the characteristics of the coating on the surface, such as color, etc., may affect the redirection characteristics of the surface. For example, a surface coated with black paint may redirect light differently than a surface coated with white paint.

In the following paragraphs, the present disclosure will be described in further detail by way of examples with reference to the attached drawings. In the description, well known components, methods, and/or processing techniques are omitted or briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s).

The present disclosure provides an example light redirecting flange that is integral with or coupled to an end plate of a luminaire's door frame assembly. In particular, the light redirecting flange may be configured to redirect light exiting through a notch in the end plate towards a lens of the luminaire. The notch in the end plate may be formed to accommodate a portion of a light emitting diode (LED) circuit board that extends beyond the end plate of the luminaire when the LED circuit board is installed in the luminaire. However, the notch may create a dark spot in the luminaire. The dark spot created by the notch may be reduced or eliminated by the light redirecting flange through a redirection of light exiting the notch—consequently achieving a more even distribution of light across the lens of the luminaire.

In particular, the light redirecting flange may be a portion of the end plate that diverges away from a remaining portion of the end plate at an angle to the remaining portion of the end plate. For example, the light redirecting flange may be formed by cutting a portion of the end plate to create the notch and pushing the portion, which forms the light directing flange, into a different plane that is at an angle with a plane in which a remainder portion of the end plate resides. Alternatively, the light redirecting flange may be a separate component that is coupled to the end plate. Specifically, the light redirecting flange may be coupled to the end plate at one of the edges of the end plate that defines the notch and may be inclined at an angle to the end plate such that light exiting the notch may be redirected towards the lens of the luminaire.

The present technology can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples" or "exemplary embodiments" given herein are intended to be non-limiting and among others supported by representations of the present technology.

Figure 1B:
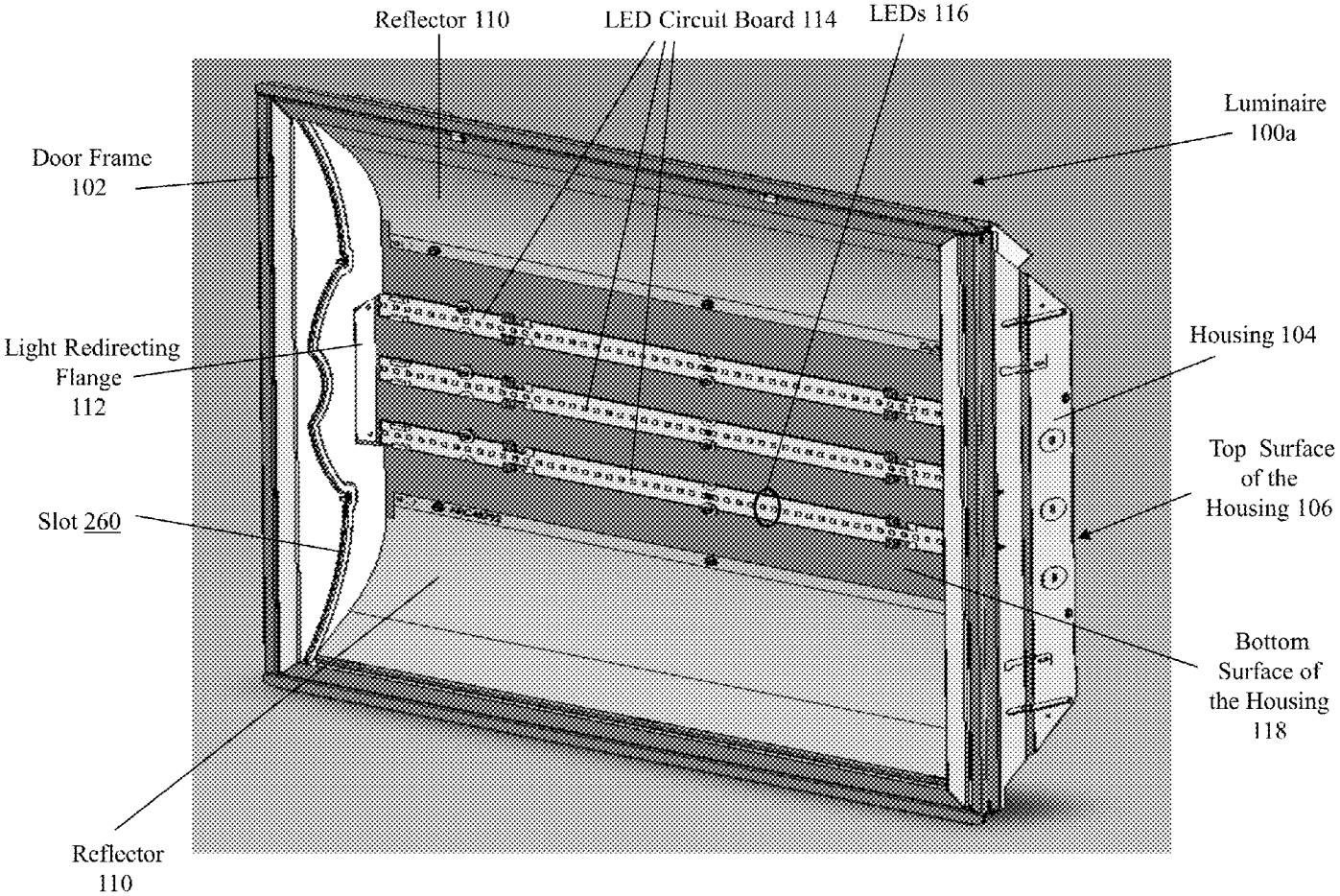
FIG. 1B illustrates a perspective view of the example luminaire of FIG. 1A in which a lens of the luminaire is removed to display the light redirecting flange and an arrangement of LEDs in the example luminaire, in accordance with example embodiments of the present disclosure.
Figure 2:
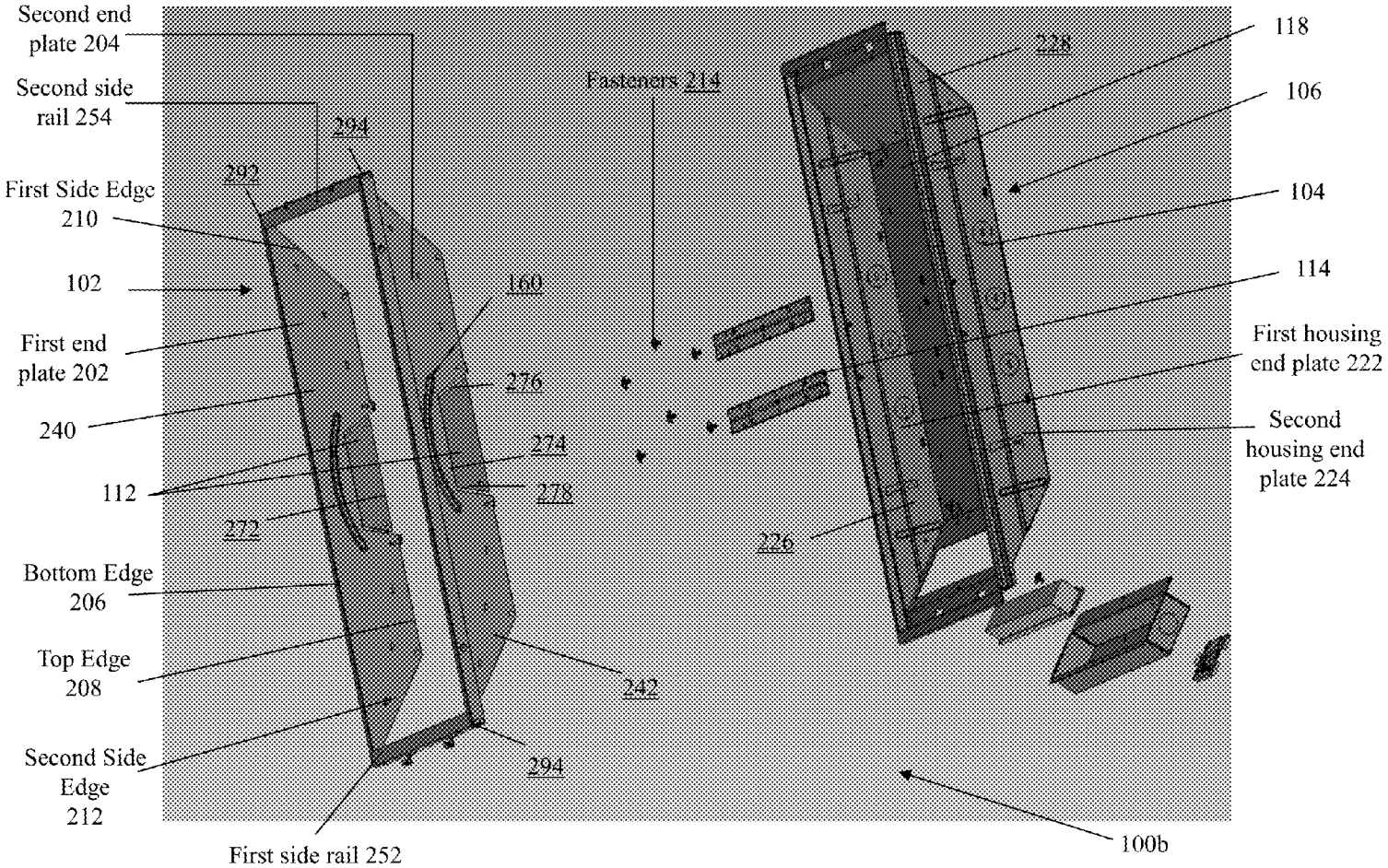
FIG. 2 illustrates an exploded view of another example luminaire, in accordance with example embodiments of the present disclosure.

Turning to FIGS. 1A-2, these figures illustrate different perspective and exploded views of example luminaires having the light redirecting flange, in accordance with example embodiments of the present disclosure. In particular, FIG. 1A illustrates a perspective view of an example luminaire comprising the light redirecting flange; and FIG. 1B illustrates a perspective view of the example luminaire of FIG. 1A in which a lens of the luminaire is removed to display the light redirecting flange and an arrangement of LEDs in the example luminaire, in accordance with example embodiments of the present disclosure. Further, FIG. 2 illustrates an exploded view of another example luminaire, in accordance with example embodiments of the present disclosure.

Although FIGS. 1A-2 illustrate recessed troffer luminaires in particular, one of ordinary skill in the art can understand and appreciate that other types of luminaires can be use a light redirecting flange without departing from a broader scope of the present disclosure. Further, even though two different example luminaires as illustrated in FIGS. 1A-2, the description of both the luminaires (100*a*, 100*b*) are collectively provided below for sake of brevity and so as not to obscure the disclosure. Accordingly, luminaire 100*a* and 100*b* will be referred to as luminaire 100 in the following description.

Referring to FIGS. 1A-2, a luminaire 100 may include a housing 104 that is coupled to a door frame assembly 102 (herein referred to as 'door frame'). In certain example embodiments, the housing 104 in unison with the door frame 102 may securely retain, inter alia, one or more light emitting diode (LED) circuit boards (herein 'circuit boards') 114 having one or more LEDs 116 disposed thereon, a lens 108 disposed over the LEDs 116, and one or more reflectors 110 adjacent the lens 108. Even though the present disclosure describes LEDs 116, one of ordinary skill in the art can understand and appreciate that any other appropriate light source may be substituted, for example, a fluorescent lamp may be substituted, without departing from a broader scope of the present disclosure.

In particular, as illustrated in FIG. 2, the door frame 102 may include a first end plate 202, a second end plate 204, a first side rail 252, and a second side rail 254. Each side rail (252, 254) may include a first lateral edge 292, a second lateral edge 294, and longitudinal edges that extend from the first lateral edge 292 to the second lateral edge 294. Further, each of the first end plate 202 and the second end plate 204 may include an interior surface 240 and an exterior surface 242. The interior surface 240 and the exterior surface 242 of each end plate (202, 204) may be bound by a bottom edge 206, a top edge 208, a first side edge 210 extending from one end of the bottom edge 206 to a corresponding end of the top edge 208, and a second side edge 212 extending from another end of the bottom edge 206 to a corresponding other end of the top edge 208. In particular, the bottom edge 206 of the first end plate 202 may extend from a first lateral edge 292 of the first side rail 252 to the first lateral edge 292 of the second side rail 254. Similarly, the bottom edge 206 of the second end plate 204 may extend from a second lateral edge 294 of the first side rail 252 to the second lateral edge 294 of the second side rail 254. Alternatively, the bottom edge 206 of each end plate (202, 204) may extend from any appropriate portion of the first side rail 252 to a corresponding portion of the second side rail 254 and may be substantially perpendicular to both the first and the second side rails (252, 254).

In certain example embodiments, the first and second side edges 210, 212 of each end plate (202, 204) may extend substantially orthogonally away from the bottom edge 206 and expand towards the top edge 208 giving the end plate a trapezoidal shape. However, in other example embodiments, the end plates (202, 204) can have any other appropriate geometric or non-geometric shape without departing from a broader scope of the present disclosure. For example, the end plates (202, 204) may be rectangular shaped where the side edges 210, 212 of the each of the first and second end plates (202, 204) do not taper from the bottom edge 206 to the top edge 208. In another example, the side edges 210, 212 of the end plates (202, 204) may taper from a bottom edge 206 to the top edge 208.

In certain example embodiments, each end plate (202, 204) of the door frame 102 may be fabricated from plastic, which is injection molded according to some exemplary embodiments. However, other suitable materials, such as aluminum, other metals, metal alloys, or other polymer types, may be used to fabricate the end plates (202, 204) in other example embodiments. Regardless of the material chosen to fabricate the end plates (202, 204), at least a portion of the interior surface 240 of the each end plate (202, 204) may be adapted to redirect light. For example, at least a portion of the interior surface 240 may be made reflective by polishing, painting with a reflective material, such as a white paint, or made to be reflective using any other methods known to people having ordinary skill in the art. Alternatively, according to some example embodiments, the interior surface 240 of the end plates (202, 204) may be non-reflective.

As illustrated in FIG. 2, each end plate (202, 204) further includes an embossment 160 formed within the interior surface 240 to receive and retain an edge of the lens 108. That is, the embossment 160 facilitates positioning of the lens 104 within the door frame 102 and also provides support to the lens 108 once positioned within the door frame 102. However, in some example embodiments, the lens 108 may be retained and supported within the door frame 102 using any other appropriate mechanism in addition to or instead of the embossment 160 without departing from a broader scope of the present disclosure.

Furthermore, each end plate (202, 204) may include a light redirecting flange 112, where the light redirecting flange 112 may be a portion of the respective end plate (202, 204) that diverges away from a remainder portion the respective end plate (202, 204) at an angle to the remainder portion of the respective end plate (202, 204) as illustrated in FIG. 2. For example, the light redirecting flange 112 of the first end plate 202 may be a portion of the first end plate 202 that diverges away from a remainder portion of the first end plate 202 at an angle to the remainder portion of the first end plate 202. Alternatively, the light redirecting flange 112 may not be a part of the end plate 202. That is, the light redirecting flange 112 may be a separate independent component that may be coupled to the end plate 202 as desired.

The term "remainder portion of the end plate," as used herein may generally refer to any appropriate portion of the end plate other than the portion that diverges away from the end plate. That is, the term "remainder portion of the end plate," as used herein may generally refer to any appropriate portion of the end plate other than the light redirecting flange 112. Herein, the light redirecting flange 112 may be interchangeably referred to as light flange 112. Although, the present disclosure describes that each end plate (202, 204) includes the light redirecting flange 112, one of ordinary skill in the art can understand and appreciate that in some embodiments, only one of the end plates may include the light redirecting flange 112 without departing from a broader scope of the present disclosure.

As illustrated in FIG. 2, the light flange 112 may include a first edge 272, a second edge 274 opposite to the first edge 272, a first side edge 276, and a second side edge 278. In particular, the first side edge 276 of the light flange 112 extends from one end of the first edge 272 to a corresponding end of the second edge 274, and the second side edge 278 of the light flange 112 extends from another end of the first edge 272 to a corresponding other end of the second edge 274. As illustrated in FIG. 2, in one example embodiment, the light flange 112 may taper from the first edge 272 to the second edge 274. However, one of ordinary skill in the art can understand and appreciate that the light flange 272 illustrated in the figures of the present disclosure is an example and does not limit the size and shape of the light flange 112. That is, the light flange 112 may have any appropriate geometric or non-geometric shape without departing from a broader scope of the present disclosure. The light flange 112 will be described in greater detail below in association with FIG. 3. However, before turning to FIG. 3, the housing 104 of the luminaire 100 may be described in greater detail below.

As illustrated in FIG. 2, the housing 104 of the luminaire 100 may include, inter alia, a first housing end plate 222, a second housing end plate 224 that is opposite to the first housing end plate 224, and a top portion 106 extending from a top edge (not shown in Figures) of the first housing end plate 222 to a top edge (not shown in Figures) of the second housing end plate 224. The top portion 106 of the housing 104 may include an exterior major surface (not shown in the Figures) and an interior major surface 118. Similarly, each of the first housing end plate 222 and the second housing end plate 224 may include an interior surface 226 and an exterior surface 228. Other components of the housing are omitted from the description so as not to obscure the disclosure.

In certain example embodiments, the housing 104 may be coupled to the door frame 102 such that the housing end plates 222 and 224 of the housing 104 fit over and overlap the respective end plates 202 and 204 of the door frame 102. That is, when the housing 104 is coupled to the door frame 102, the interior surface 226 of each housing end plate 222, 224 is positioned adjacent to and faces the exterior surface 242 of the respective end plates (202, 204) of the door frame 102. Further, in certain example embodiments, the circuit boards 114 are coupled to the interior major surface 118 of the top portion 106 of the housing 104 using fasteners 214, as illustrated in FIG. 2. However, in other example embodiments, any other appropriate coupling mechanisms may be used to couple the circuit boards 114 to the housing 104. Further, although a specific configuration of different components, such as the door frame 102, the housing 104, the circuit board 114, the lens 108, the reflectors 110, etc., of the luminaire 100 is described herein, one of ordinary skill in the art can understand that a different configuration than that illustrated in the example figures of the present disclosure may be substituted without departing from a broader scope of the present disclosure.

Figure 3A:
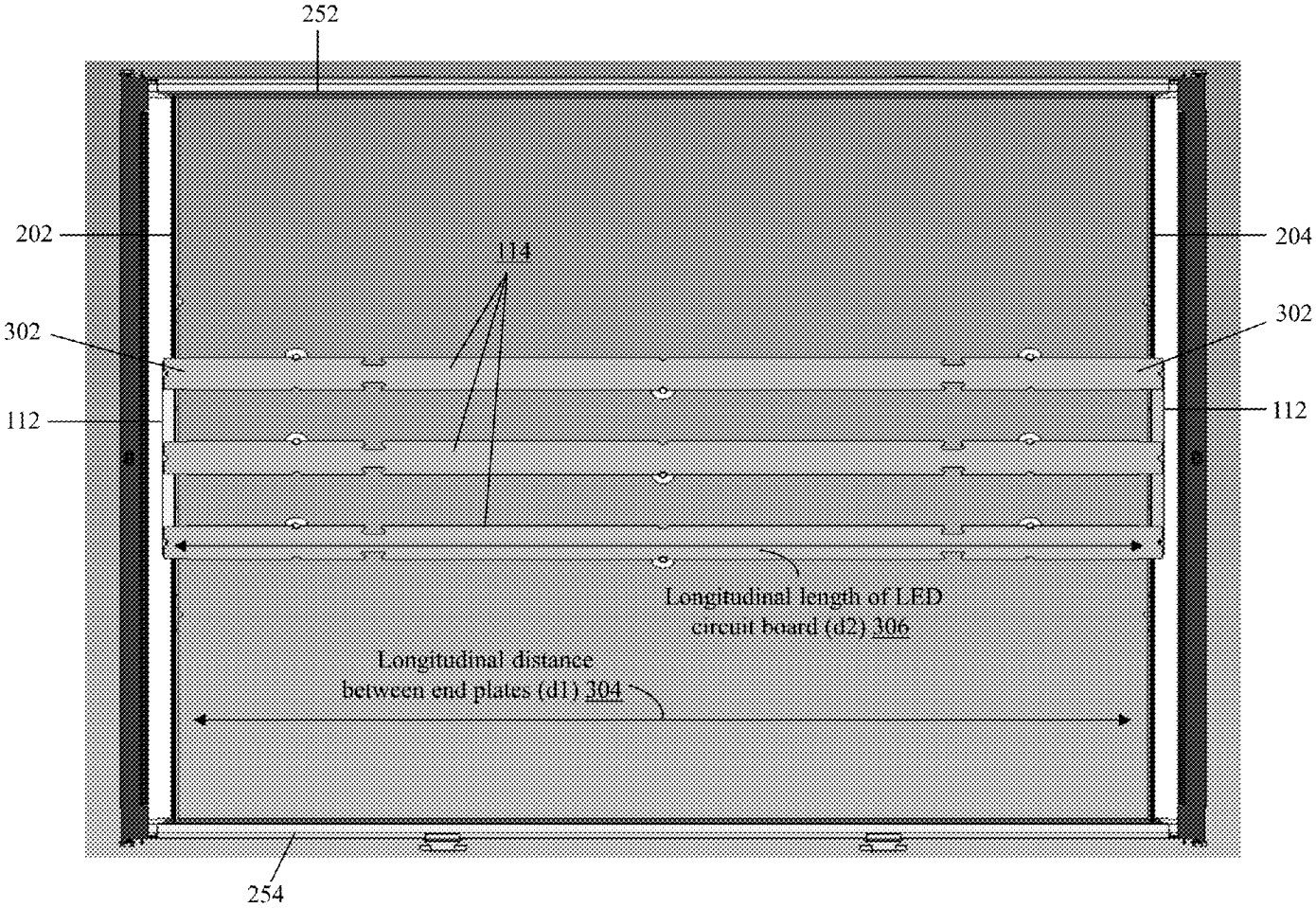
FIGS. 3A to 3D (collectively 'FIG. 3') illustrate different views of an example door frame assembly of the luminaire in FIG. 1A, in accordance with example embodiments of the present disclosure.
Figure 3B:
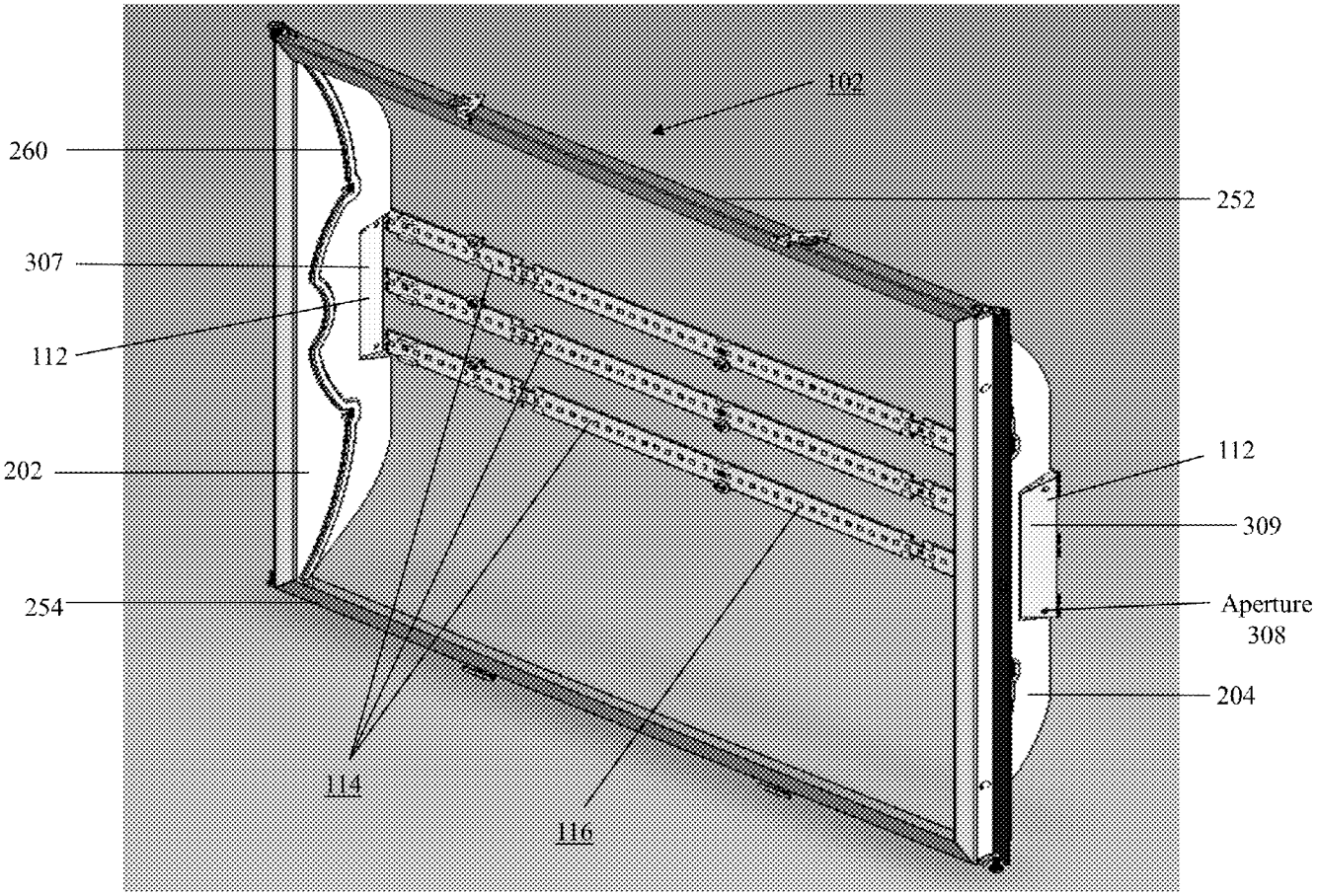
Figure 3C:
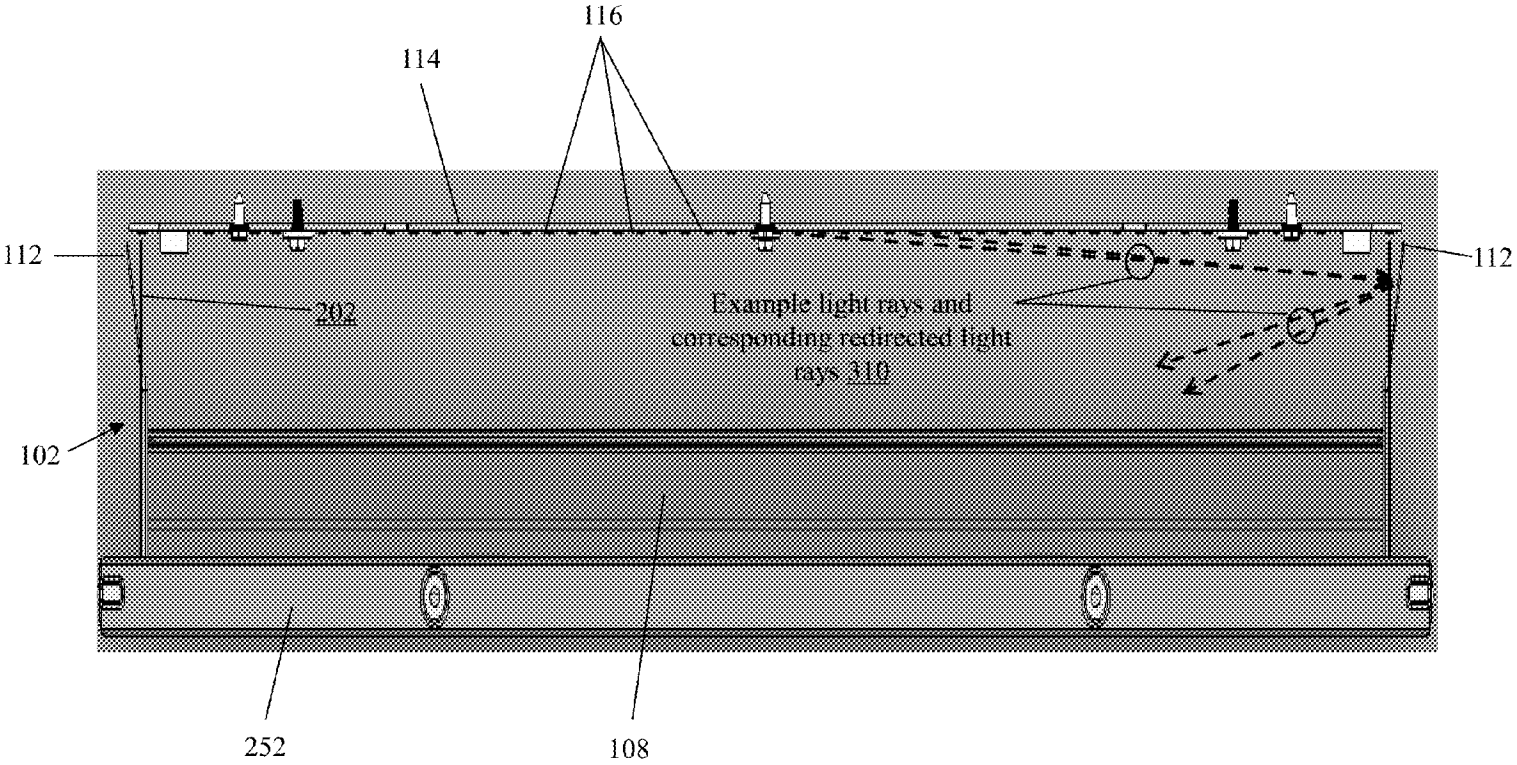
Figure 3D:
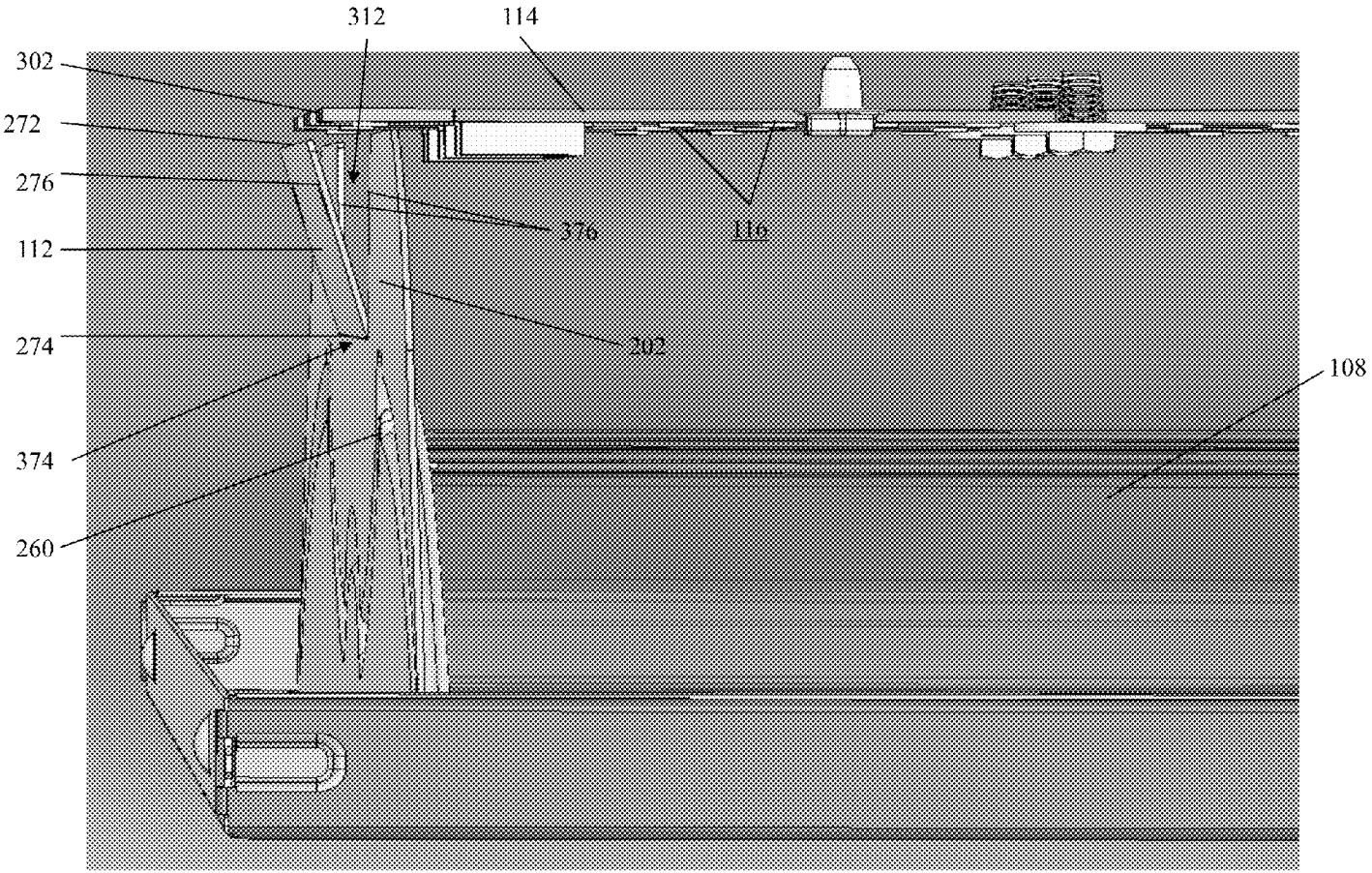

Now turning to FIGS. 3A-3D, these figures illustrate different views of the door frame assembly of the luminaire, in accordance with example embodiments of the present disclosure. In particular, FIG. 3A illustrates a top view of the door frame 102 along with the circuit boards; FIG. 3B illustrates a perspective view of the door frame 102 along with the circuit boards; FIG. 3C illustrates a cross-sectional side view of the door frame along with the circuit boards; and FIG. 3D illustrates a close up view of one of the end plates of the door frame along with the circuit boards, in accordance with example embodiments of the present disclosure.

Although the door frame 102 includes two end plates (202, 204), hereinafter, the description of both end plates (202, 204) is collectively provided below for the sake of brevity and so as not to obscure the disclosure. Similarly, although the door frame 102 includes two side rails 252, 254, hereinafter, the description of both side rails 252, 254 is collectively provided below for the sake of brevity and so as not to obscure the disclosure. Accordingly, end plates 202 and 204 will be referred to as end plate 202, and side rails 252 and 254 will be referred to as side rail 252 in the following description.

Referring to FIGS. 3A-3D, the end plate 202 includes a notch 312 that is formed to allow placement of the one or more circuit boards 114 that extend into an area that the door frame 102 encloses when the door frame 102 is coupled to the housing 104. As illustrated in the example embodiment of FIG. 3A, the longitudinal length 306 of a circuit board 114 (referred to as length d2) may be greater than the longitudinal distance 304 between the two opposite end plates 202 and 204 (referred to as length d1). Accordingly, the notch 312 may be formed in the end plates (202, 204) to accommodate the ends 302 of the circuit board 114 that extend beyond the longitudinal distance d1 between the two opposite end plates 202 and 204 of the door frame 102.

In particular, the circuit boards 114 are positioned such that they are adjacent to and extend over the top edges 208 of the end plates (202, 204). Accordingly, the notch 312 is formed at the top edge 208 of end plates (202, 204). In certain example embodiments, as illustrated in FIG. 3D, the notch 312 may include a base edge 374, where the base edge 374 may be offset above the bottom edge 206 of the end plate 202. That is, the base edge 374 of the notch 312 may be positioned on the end plate 202 at a distance 'd' above the bottom edge 206 and/or the slot 160 of the edge plate 202. The distance d may be determined based on the desired depth and/or shape of the notch 312 and/or the shape of the light flange 112. Further, the notch 312 may include two side edges 376 that extend towards and through a portion of the top edge 208 of the end plate 202 from either ends of the base edge 374. In other words, the notch 312 extends from a portion of the top edge 208 of the end plate 202 through the base edge 374 on the end plate 202. In an example embodiments, the side edges 376 and the base edge 374 of the end plate 202 define the notch 312.

In some embodiments, the side edges 376 of the notch 312 may extend towards the top edge 208 of the end plate 202 at an angle with respect to the base edge 374 as illustrated in FIGS. 1B, 2, 3B, and 4B, i.e., the notch 302 can taper or expand from the base edge 374 towards the top edge 208 of the end plate 202. However, in other example embodiments, the side edges 376 of the notch 312 may extend substantially perpendicular to the base edge 374.

Although the present disclosure illustrates and describes the notch 312 as being formed at a top edge 208 of the end plate 202 to accommodate LED circuit boards 114, one of ordinary skill in the art can understand and appreciate that the notch can be formed at any other appropriate portion of the end plate 202 to accommodate any other appropriate component of the luminaire without departing from a broader scope of the present disclosure. Further, even though the present disclosure illustrates and describes the notch 312 as being open on one side and enclosed on the other sides by the base edge and the side edges, one of ordinary skill in the art can understand and appreciate that in some embodiments, the notch may be fully enclosed, may have any number of edges, and/or may have any appropriate shape without departing from a broader scope of the present disclosure. For example, the notch 312 may be a V-shaped notch that does not include a base edge 374.

In certain example embodiments, the notch 312 in the end plate 202 may create a dark spot in the luminaire 100 as some of the light from the LEDs 116 on the circuit board 114 exits through the notch 312 rather than the lens 108 disposed over the LEDs 116. The dark spot may create uneven illumination of the luminaire 100 across the lens 108 of the luminaire 100. Further, the notch 312 may also compromise a light output, a light distribution efficacy, and an aesthetic look of the luminaire 100.

To address the above-mentioned issues resulting from the notch 312, as illustrated in FIGS. 3A-3D, the end plate 202 may include a light flange 112 that is either integral with or coupled to the end plate 202. In particular, the light flange 112 may be positioned adjacent to the notch 312 of the end plate 202 and positioned at an angle to the end plate 202 to redirect the light exiting through notch 312 towards the lens 108 of the luminaire 100, as illustrated using example light rays 310 in FIG. 3C. This redirected light may reduce or eliminate the dark spot resulting from the notch 312, provide even distribution of light across the lens 108 of the luminaire 100, increase the light distribution efficacy, and improve aesthetic looks of the luminaire 100.

In certain example embodiments, the light flange 112 may be formed by cutting a portion of the end plate 202 to form the notch 312 beginning at the top edge 208 of the end plate 202 and extending to the base edge 374 of the notch 312 on the end plate 202. Further, the portion of the end plate 202 that is cut to form the notch 302 is pushed to diverge away from a remainder portion of the end plate 202 and rest at an angle with respect to the remainder portion of the end plate 202 as illustrated in FIGS. 3C and 3D. The portion that is cut and pushed to diverge away from the remainder portion of the end plate 202 forms the light flange 112. Alternatively, the portion may be cut out and separated from the end plate 202 to form the notch 312. Further, the cut out and separated portion may be coupled to the end plate 202 as the light flange 112. Accordingly, the shape of the light flange 112 may substantially match a shape of the notch 312, in some embodiments. However, in other example embodiments, the shape of the light flange 112 may be different from the shape of the notch 312.

In some example embodiments, if the light flange 112 is pushed back into the plane in which the remainder portion of the end plate 202 resides, there may be a gap between the side edges 276 and 278 of the light flange 112 and the respective side edges 376 of the notch 312. However, in other example embodiments, there may be no gaps between the side edges 276 and 278 of the light flange 112 and the respective side edges 376 of the notch 312 when the light flange 112 is pushed back into the plane in which the remainder portion of the end plate 202 resides.

In the example embodiment where the light flange 112 is formed by cutting a portion of the end plate 202 to form the notch 312 and pushing the portion to diverge away from a remainder portion of the end plate 202, the light flange 112 may be integral with the end plate 202 at a base edge 374 of the notch 312 in the end plate 202. Accordingly, the light flange 112 may be inclined upwardly away from the top edge 208 of the end plate 202. For example, the first edge 272 and the side edges 276, 278 of the light flange 112 may extend away from the top edge 208 of the end plate 202 while the second edge 274 of the light flange 112 remains integral with the base edge 374 of the notch 312 in the end plate 202.

In an alternative example embodiment, the light flange 112 may be a separate single-part or multi-part component that is coupled at an angle to the end plate 202 adjacent to the notch 312 of the end plate 212 to redirect light exiting through the notch 312 of the end plate 202 towards the lens 108 of the luminaire 100. In one example, as described above, the second edge 274 of the light flange 112 may be coupled to the base edge 374 of the notch 312 while the first edge 272 of the light flange 112 extends away from the top edge 208 of the end plate 202. In other words, the light flange 112 is coupled to the end plate 202 such that the light flange 112 diverges away from the end plate 202 and is inclined in an upward direction forming an angle with the end plate 202. One of ordinary skill in the art can understand and appreciate that any appropriate coupling mechanism, such as by welding, by using fasteners, etc. may be used to couple the light flange 112 to the end plate 202.

Irrespective of whether the light flange 112 is integral with or coupled to the end plate 202, the angle that the light flange 112 forms with the end plate 202 may depend on, but is not limited to, the notch 312, the light flange 112 itself, a placement, position, and/or configuration of the circuit boards 114 and the LEDs 116, a position and configuration of the lens 108 of the luminaire 100, and a desired redirection of light from the LEDs. Further, in certain example embodiments, the light flange 112 may be inclined outwardly, i.e., towards the end plates 222 and 224 of the housing. Alternatively, in other example embodiments, the light flange 112 may be inclined inwardly, i.e., towards the lens 108 of the luminaire 100 and away from the respective end plate 222 or 224 of the housing 104. Furthermore, although the present disclosure describes the light flange 112 as being inclined in an upward direction, one of ordinary skill in the art can understand and appreciate that in some embodiments, the light flange 112 may be inclined in any other appropriate direction without departing from a broader scope of the present disclosure. For example, the light flange 112 may be inclined in a downward direction, i.e., towards the bottom edge 206 of the end plate 202. In said example, the notch 312 may extend from the base edge 374 toward the bottom edge 206 of the end plate 202 rather than the top edge 208 of the end plate 202. Additionally, even though the present disclosure describes the light flange 112 as being coupled to or integral with the base edge 374 of the notch 312 in the end plate 202, one of ordinary skill in the art can understand and appreciate that in some embodiments, any other appropriate edge of the light flange 112 may be coupled to or integral with any other appropriate edge of the notch 312 without departing from a broader scope of the present disclosure. For example, the side edge 276 of the light flange 112 may be coupled to the side edge 376 of the notch 312 instead of or in addition to coupling the second edge 374 of the light flange 112 to the base edge 374 of the notch 312.

Referring to FIG. 3B, the light flange 112 may include a first major surface 307 and a second major surface 309, where one major surface faces an inwardly towards the circuit board 114 and the other major surface faces outwardly towards the housing 104. The major surface facing the inward direction may be interchangeably referred to as inward facing surface of the light flange 112, e.g., the first major surface 307, and the major surface facing the outward direction may be interchangeably referred to as the outward facing surface of the light flange 112, e.g., the second major surface 309. In one example, the outward facing surface may face the end plate 222 of the housing 104 and the inward facing surface may face a direction away from the end plate 222, i.e., towards the LEDs 116.

In certain example embodiments, the light flange 112 may be fabricated using the same material as that of the end plates (202, 204). However, in other example embodiments, the light flange 112 may be fabricated using any appropriate material that is different from that of the end plates (202, 204). For example, the light flange 112 may be fabricated from plastic, which is injection molded according to some example embodiments. However, other suitable materials, such as aluminum, other metals, metal alloys, or other polymer types, may be used to fabricate the light flange 112, in other example embodiments. Regardless of the material chosen to fabricate the light flange 112, at least a portion of the inward facing surface 307 of the light flange 112 may be adapted to redirect light. For example, at least a portion of the inward facing surface 307 is made to be reflective by polishing, painting with a reflective material, such as a white paint, or made to be reflective using any other methods known to people having ordinary skill in the art. Alternatively, according to some example embodiments, the inward facing surface 307 of the light flange 112 may be non-reflective.

Further, the light flange 112 may include one or more apertures 308 that extend from the first major surface 307 through the second major surface 309. That is the aperture 308 may be a through hole. However, in some example embodiments, the aperture 308 may be a blind hole. In particular, the one or more apertures 308 may be formed adjacent each end of the first edge 272 of the light flange 112, as illustrated in FIG. 3C. However, in other example embodiments, the one or more apertures 308 may be formed at any other portion of the light flange 112. Furthermore, the one or more apertures 308 may be adapted to engage and securely retain wiring support members 402 (shown in FIG. 5). For example, the aperture 308 maybe larger of smaller, and the aperture 308 may have any appropriate geometric or non-geometric shape to engage a wiring support member 402 or any appropriate component of the luminaire 100.

Figure 4A:
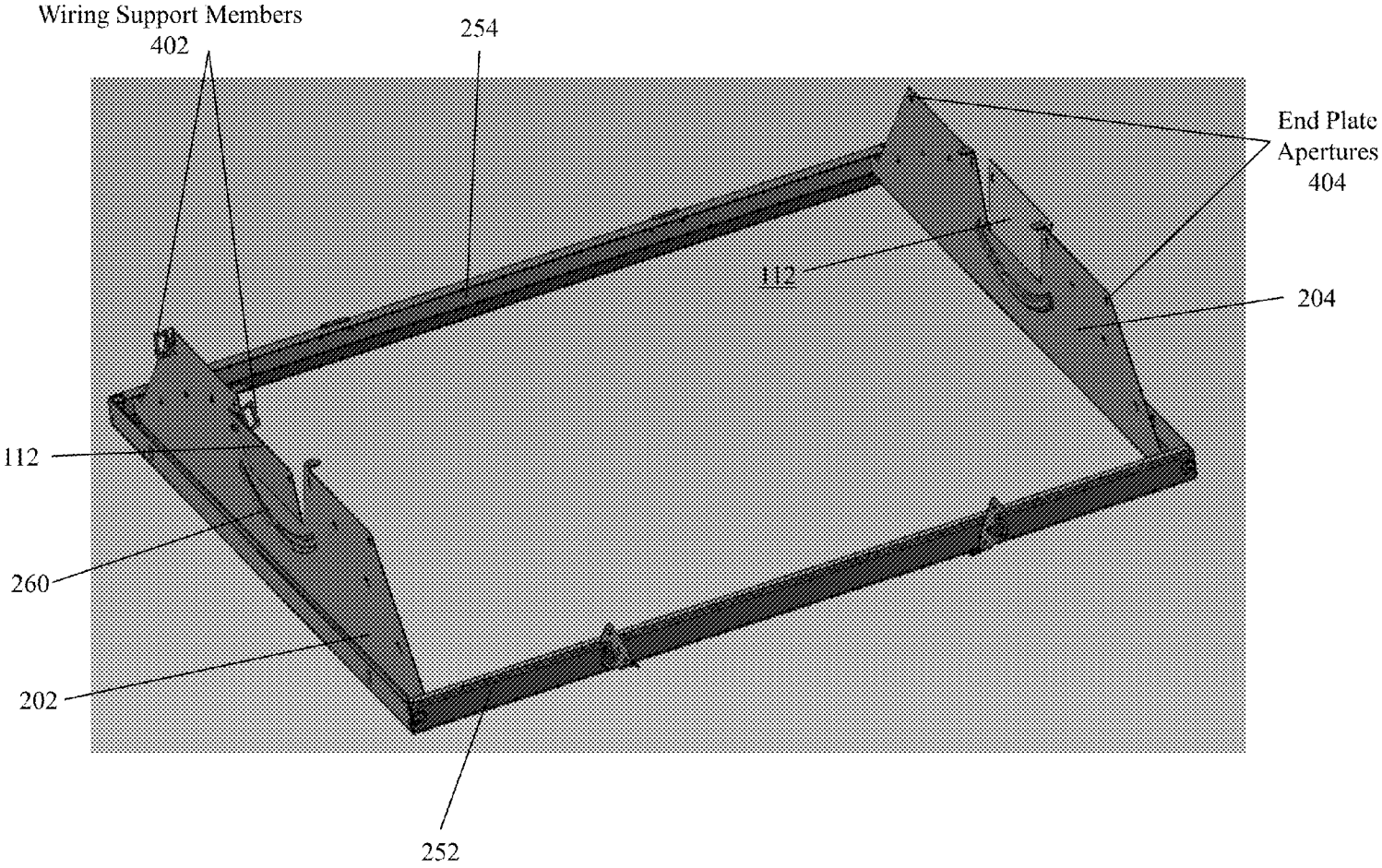
FIGS. 4A and 4B (collectively 'FIG. 4') illustrate different views of an example door frame assembly of the luminaire in FIG. 2 with wiring support members therein, in accordance with example embodiments of the present disclosure.
Figure 5:
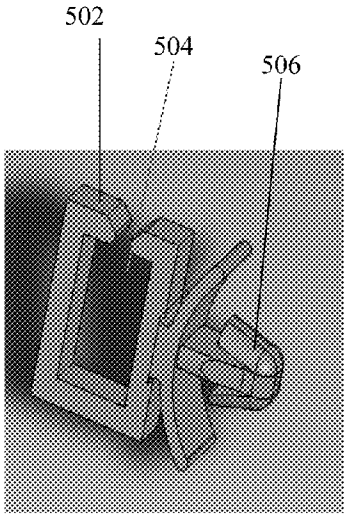
FIG. 5 illustrates an example wiring support member, in accordance with example embodiments of the present disclosure.
Figure 4B:
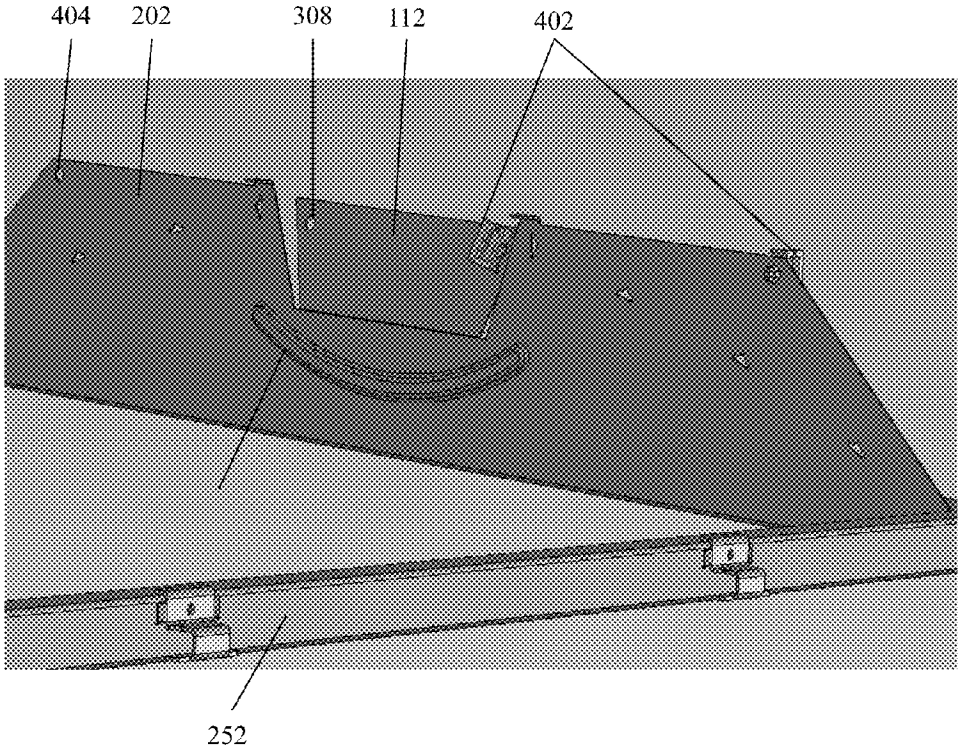

Turning to FIGS. 4 and 5, these figures illustrate different views of the door frame with the wiring support members. In particular, FIG. 4 illustrates the door frame with the wiring support members coupled to the door frame; and FIG. 5 illustrates an example wiring support member, in accordance with example embodiments of the present disclosure. Referring to FIGS. 4B and 5, the wiring support members 402 may be coupled to the light flange 112 and/or the end plate 202 to securely retain and channel the electrical wires associated with the luminaire in a concealed manner. In particular, the wiring support members 402 may be coupled to the light flange 112 and the end plate 202 via the aperture 308 of the light flange 112 and via an aperture 404 of the end plate 202, respectively, as illustrated in FIG. 4B.

In particular, the example wiring support member 402 illustrated in FIG. 5 may include a first portion 502 which includes an opening 504. Further, the wiring support member 402 may include a second portion 506 that passes through the aperture 404 of the end plate 202 or the aperture 308 of the light flange 112 to couple to the end plate 202 or the light flange 112, respectively. One of ordinary skill in the art can understand and appreciate any other appropriate wiring support member can be substituted without departing from a broader scope of the present disclosure. Further, even though the present disclosure describes coupling the wiring support member to the end plate and/or the light flange by engaging the second portion of the wiring support member with the aperture of the end plate and/or the light flange, one of ordinary skill in the art can understand and appreciate that in some embodiments, the light flange 112 and/or the end plates 202 may not include the apertures and any other coupling mechanisms, such as, but not limited to adhesives, welding, fasteners, etc., may be used without departing from a broader scope of the present disclosure.

Although embodiments described herein are made with reference to example embodiments, it should be appreciated by those skilled in the art that various modifications are well within the scope and spirit of this disclosure. For example, each feature of one embodiment can be mixed and matched with other features shown in other embodiments. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A door frame assembly of a luminaire, comprising:

a first side rail and a second side rail that is opposite to the first side rail;

an end plate comprising: a bottom edge that extends from one end of the first side rail to one end of the second side rail; and a top edge opposite to the bottom edge, wherein the end plate extends from the bottom edge to the top edge;

an opposite end plate that extends from an opposite end of the first side rail to an opposite end of the second side rail; and a light redirecting flange comprising a portion of the end plate that diverges away from a remainder portion of the end plate at an angle to the remainder portion of the end plate, wherein the door frame assembly is disposed in a housing that comprises at least one elongate circuit board disposed on a top wall of the housing, the at least one elongate circuit board comprising an array of light emitting diodes (LEDs) disposed thereon, wherein when the door frame assembly is disposed in the housing, the end plate and the opposite end plate of the door frame assembly are substantially perpendicular to a longitudinal axis of the at least one elongate circuit board, the length of the at least one elongate circuit board being longer than a distance between the end plate and the opposite end plate of the door frame assembly such that a portion of the at least one elongate circuit board extends beyond the end plate, wherein the end plate comprises a notch that is formed therein to receive the portion of the at least one elongate circuit board that extends beyond the end plate, the notch extending from at least a portion of the top edge of the end plate towards the bottom edge of the end plate, and wherein the light redirecting flange is substantially flat and one edge of the light redirecting flange is coupled the endplate at a portion of a perimeter of the notch while a remainder of the edges of the light redirecting flange are detached from the endplate.

2. The door frame assembly of claim 1, wherein a shape of the notch substantially matches a shape of the light redirecting flange.

3. The door frame assembly of claim 1:

wherein the light redirecting flange comprises an inward facing surface and an outward facing surface that is opposite to the inward facing surface, wherein the inward facing surface and the outward facing surface are enclosed by the one edge and the remainder of the edges of the light redirecting flange, wherein the edge is a first edge that is coupled to the end plate, and wherein the remainder of the edges include:

a second edge that is opposite to the first edge; and a first side edge and a second side edge opposite to the first side edge, the first side edge and the second side edge extending between the first edge and the second edge.

4. The door frame assembly of claim 1, wherein the light redirecting flange is rectangular in shape.

5. The door frame assembly of claim 1, wherein the light redirecting flange diverges from a remainder portion of the end plate towards an outer portion of the luminaire in a direction away from the opposite end plate.

6. The door frame assembly of claim 1, wherein the light redirecting flange is inclined upwards and away from a top edge of the end plate, and wherein the light redirecting flange is detached from the top edge of the end plate.

7. The door frame assembly of claim 1, wherein the light redirecting flange includes one or more through apertures that receive and retain wiring support members therein, and wherein the wiring support members are configured to route electrical wiring of a light fixture therethrough in a concealed manner.

8. The door frame assembly of claim 3, wherein the light redirecting flange is trapezoidal in shape where the light redirecting flange tapers from the first edge to the second edge.

9. The door frame assembly of claim 3, wherein the inward facing surface of the light redirecting flange is adapted to redirect light exiting through a notch in the end plate towards a lens of the luminaire.

10. A luminaire comprising:

a housing that has a top wall, a first end plate, and a second end plate that is opposite to the first end plate, wherein the first end plate and the second end plate extend from opposite edges of the top wall;

at least one elongate circuit board coupled to the top wall of the housing and comprising an array of light emitting diodes (LED) disposed thereon; and a door frame assembly coupled to and disposed within the housing, wherein the door frame assembly comprises:

a first side rail and a second side rail that is opposite to the first side rail;

an end plate extending from a portion of the first side rail to a corresponding portion of the second side rail and having a top edge and a bottom edge opposite to the top edge;

an opposite end plate extending from an opposite portion of the first side rail to a corresponding opposite portion of the second side rail; and a light redirecting flange that is substantially flat and coupled to the end plate at a portion of a perimeter of a notch that is formed in the end plate to receive a portion of the at least one elongate circuit board that extends beyond the end plate, the light redirecting flange diverging away from the end plate at an angle to the end plate such that light from the array of LEDs that exits the luminaire through the notch is redirected towards a lens of the luminaire, wherein one edge of the light redirecting flange is coupled the endplate at the portion of the perimeter of the notch while a remainder of the edges of the light redirecting flange are detached from the endplate, wherein the door frame assembly is disposed within the housing such that the first end plate of the housing overlaps the end plate of the door frame assembly and the second end plate of the housing overlaps the opposite end plate of the door frame assembly, and wherein the end plate and the opposite end plate of the door frame assembly are substantially perpendicular to the at least one elongate circuit board, the length of the at least one elongate circuit board being longer than a distance between the end plate and the opposite end plate of the door frame assembly.

11. The luminaire of claim 10, wherein the light redirecting flange comprises:

an inward facing surface and an outward facing surface that is opposite to the inward facing surface, wherein the inward facing surface and the outward facing surface are bounded by the edge and the remainder of the edges, wherein the edge is a first edge that is coupled to the end plate, and wherein the remainder of the edges include:

a second edge that is opposite to the first edge; and a first side edge and a second side edge opposite to the first side edge, the first side edge and the second side edge extending between the first edge and the second edge.

12. The luminaire of claim 10, wherein the light redirecting flange is inclined upwardly away from the top edge of the end plate.

13. The luminaire of claim 10, wherein the light redirecting flange includes one or more through apertures that engage with wiring support members.

14. The luminaire of claim 10, wherein the shape of the notch substantially matches a shape of the light redirecting flange.

* * * * *